United States Patent [19]

Hanamoto et al.

[11] 4,383,756

[45] May 17, 1983

[54] COUNTER CONTROL IN ELECTROPHOTOGRAPHIC COPIER

[75] Inventors: Hiroyuki Hanamoto; Yoshihiro Horie, both of Toyokawa, Japan

[73] Assignee: Minolta Camera Kabushiki Kaisha, Osaka, Japan

[21] Appl. No.: 281,046

[22] Filed: Jul. 7, 1981

[30] Foreign Application Priority Data

Jun. 4, 1981 [JP] Japan ..... 56-86496

[51] Int. Cl.[3] ..... G03G 15/00

[52] U.S. Cl. ..... 355/14 CU; 355/3 SH; 355/14 SH

[58] Field of Search ..... 355/14 CU, 14 C, 14 R; 364/200, 100, 107, 518, 519, 523; 340/146.3 H, 146.3 Y, 146.3 FD, 706, 718, 732, 736; 235/92 SB, 92 CC, 91 R

[56] References Cited

U.S. PATENT DOCUMENTS

| | | | |
|---|---|---|---|
| Re. 29,274 | 6/1977 | Collette et al. | 355/14 CU X |
| 3,572,586 | 3/1971 | Suzuki | 235/91 R |
| 3,576,431 | 4/1971 | Zaccaro | 235/92 SB |
| 3,682,544 | 8/1972 | Glaser | 355/14 CU |
| 3,698,805 | 10/1972 | Hickey et al. | 355/14 CU |
| 3,710,079 | 1/1973 | Cralle, Jr. et al. | 355/14 CU X |
| 4,285,591 | 8/1981 | Botte et al. | 355/14 CU X |

*Primary Examiner*—A. C. Prescott

*Attorney, Agent, or Firm*—Wenderoth, Lind & Ponack

[57] ABSTRACT

A counter control device for use in an electrophotographic copying machine operable selectively in one of a multi-copy mode wherein a copying operation is repeated to produce a plurality of copies with copying papers being automatically fed one at a time and a manual feed mode wherein the copying operation is carried out by the use of copying papers fed manually one at a time. The counter control device includes a multi-copy mode counter, a manual feed mode counter and a display unit capable of displaying the number of copies to be made not only in the multi-copy mode but in the manual feed mode, thus eliminating the need for utilizing any other complicated counter device or special display unit.

7 Claims, 10 Drawing Figures

COUNTER CONTROL IN ELECTROPHOTOGRAPHIC COPIER

BACKGROUND OF THE INVENTION

The present invention relates generally to an electrophotographic copying machine of a type having a multi-copy mode in which the machine performs its copying operation with copying papers automatically fed one at a time from a paper supply unit and a manual feed mode in which the machine performs its copying operation with copying papers fed manually one at a time.

In general, a present-day electrophotographic copying machine is so designed that, if the operator of the machine preset to a counter the number of copies desired to be made, the copying operation can be repeated in succession a number of cycles equal to the number of copies desired to be made. At this time, the contents of the counter are displayed by a digit display unit utilizing either light emitting diodes or liquid-crystal display elements to show the number of copies being made. The method for displaying or counting the copies being made is generally based on a count-down system such as disclosed in the U.S. Pat. No. 4,105,914, or a count-up system. Some copying machines employ either a display unit capable of showing a preset number of copies to be made or a counter for counting the number of copies being made in combination with a count-down counter or a count-up counter, examples of which are disclosed in the U.S. Pat. No. 4,202,622 and the Japanese Laid-open Patent Publications No. 53-125839 and No. 53-127729 both laid open to public inspection in 1978.

For enabling an images to be copied on each side of a copying paper and/or enabling a special paper to be utilizable in reproduction of an image, some conventional copying machines have a manual paper feed unit provided separately of an automatic paper feed unit so that the machine can be set to operate with the copying papers manually fed from the manual paper feed unit at a time and with the copying papers automatically fed from the automatic paper feed unit at the other time.

One form of the manual paper feed unit comprises a manual feed table supported by a machine housing for pivotal movement between closed and opened position such that, when the table is held in the opened position, the machine can automatically set to operate under a sequence control mode with the copying paper manually fed through the table and, at the same time, the machine can be held in condition ready to receive the copying papers manually fed one at a time. An example of this is disclosed in the U.S. Pat. No. 4,204,668.

Another form of the manual feed unit comprises a removable feed table having a signal generating element such as a magnet or an actuating projection, which removable feed table can be removably inserted or loaded in a paper supply unit so designed as to accommodate a paper cassette containing a stack of copying papers. In this construction, when the removable feed table is loaded in the machine in place of the paper cassette, the signal generating element carried thereby actuates a switch element to set the machine in a condition ready to operate with copying papers manually fed through the removable feed table.

In any event, any one of the conventional copying machine is so designed that, when the automatic paper feed unit is in operation a counter counts the number of copies being made, and the display unit displays the number of copies actually made or left unfinished on the basis of a result of the counting operation of the counter. No conventional copying machine even though it has a capability of accommodating copying papers manually supplied one at a time in addition to the capability of accommodating the paper cassette containing a stack of copying papers, has not yet been provided with means for displaying the number of copies made on the manually supplied copying papers, and accordingly, the operator of the machine has long been forced to encounter with such an inconvenience as to count the number of copies by memorizing it. This is particularly true where a number of copies each having its opposite faces bearing respective images are made in succession using either ordinary copying papers or special papers.

Accordingly, the applicant of the present invention previously proposed an arrangement in which the preset counter acts also as a counter device for counting the number of copies made on the manually supplied copying papers in the Japanese Patent Application No. 55-40982. However, the above described arrangement has an inherent disadvantage that it cannot be applied to a copying machine of a type in which copying papers can be fed manually at any time. Namely, in the copying machine of the type which does not require to be switched over to the manual feed mode so as to be operated with copying papers being manually fed, the preset counter cannot be switched over to the counter device for counting the manually fed copying papers and thus, the preset counter cannot act also as the counter device for counting the manually fed copying papers.

SUMMARY OF THE INVENTION

Accordingly, the present invention has been developed with a view to substantially eliminating the above described disadvantages and inconveniences and has for its essential object to provide a counter control device for an electrophotographic copying machine, which can display the number of copies made even when the machine performs its copying operation in a manual feed mode with copying papers manually supplied one at a time, without utilizing any other display unit, and which is also applicable to an electrophotographic copying machine of a type in no need of being switched over to the manual feed mode so as to be operated with copying papers being manually fed.

Another important object of the present invention is to provide a counter control device of the type referred to above which does not require the user of the machine to pay attention to the number of copies displayed during the course of making such copies with the machine.

A further object of the present invention is to provide a counter control device of the type referred to above which can be manufactured with a minimized number of parts and, therefore, does not unreasonably increase the manufacturing cost of the machine.

To this end, in an electrophotographic copying machine operable selectively in one of a multi-copy mode wherein a copying operation is repeated to produce a plurality of copies with copying papers being automatically fed one at a time and a manual feed mode wherein the copying operation is carried out with copying papers fed manually one at a time, a counter control device according to the present invention comprises a counter means for performing a counting operation each time one cycle of copying operation in the multi-copy mode completes; a display means for displaying a numerical figure in association with count contents of the counter means; a manual feed mode counter means capable of performing a counting operation each time one cycle of copying operation in the manual feed mode completes; a setting means for causing the manual feed mode counter means to be operative; and a control means for causing the display means to display count contents of the manual feed mode counter means only when the copying operation in the manual feed mode is performed with the manual feed mode counter means being made operative by the setting means.

Accordingly, in an electrophotographic copying machine to which a counter control device according to the present invention is applied as described above, it is possible to display the number of copies made on the manually fed papers without utilizing any other complicated counter device or special display device.

Furthermore, since the above described electrophotographic copying machine is provided with, for example, a table for manual paper feeding, it is possible to perform a copying operation in the manual feed mode unless the copying operation is performed in the multi-copy mode. Namely, when a print switch is depressed in the wait mode, the copying operation in the multi-copy mode is performed and the copying operation in the manual feed mode is carried out if a manual paper feeding sensor detects the leading edge of a copying paper.

BRIEF DESCRIPTION OF THE DRAWINGS

These and other objects and features of the present invention will become apparent from the following description taken in conjunction with the preferred embodiment thereof with reference to the accompanying drawings, in which.

Before the description on the present invention proceeds, it is to be noted that like parts are designated by like reference numerals throughout the views of the accompanying drawings.

DETAILED DESCRIPTION OF THE INVENTION

Figure 3:
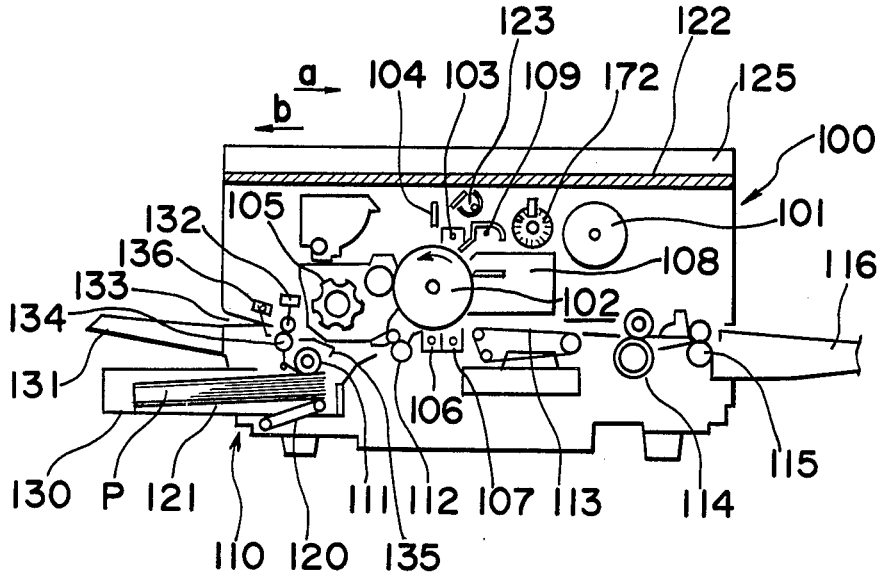
FIG. 3 is a schematic side sectional view of the copying machine of FIG. 1.

Referring now to the drawings, there is shown in FIG. 3 an electrophotographic copying machine 100 in which a counter control device according to one preferred embodiment of the present invention is employed and whose operations are controlled by a microcomputer. The electrophotographic copying machine 100 includes a photoreceptor drum 102 which is rotatably mounted approximately at a central portion of a machine housing for rotation in the counterclockwise direction, and around which a corona charger 103, an optical system 104 comprised of an image transmitter formed of a plurality of graded index fibers in bundled configuration, etc., a developing device 105, a transfer charger 106, an a.c. charge eraser 107, a cleaning device 108, an eraser lamp 109, etc. are sequentially disposed in a known manner so as to successively process the photoreceptor surface of the drum 102 by corona charging, exposure, development, etc. in response to the rotation of the drum 102 driven by a main motor, whereby the powder image or visible toner image on the drum 102 is transferred onto a copying paper P transported synchronously with rotation of the drum 102.

Meanwhile, feeding of copying papers P and P′ of the copying machine 100 comprises an automatic paper feeding in which copying papers P are automatically fed one at a time and a manual paper feeding in which copying papers P′ are manually fed one at a time. Copying papers P to be fed automatically are stacked in a cassette 130 provided at a paper receptacle portion 110 and are upwardly shifted by a lifting member 120 through a plate 121 of the cassette 130 to contact an automatic paper feeding roller 111 which is rotatably provided adjacent to and above the leading edge of a top sheet of the stack of the copy papers P for feeding the copying papers one at a time from the cassette 130 towards timing rollers 112.

On the other hand, when copying papers P′ for manual feeding are manually placed on a paper feeding table 131 provided above the paper receptacle portion 110 and the leading edges thereof are inserted into an inlet portion 133 one at a time, the copying papers P′ are transported to the timing rollers 112 through a guide plate 135 by a pair of manual paper feeding rollers 134 which are rotatably provided adjacent to the inlet portion 133 and which are driven through a manual paper feeding clutch 132. Such a copying operation in which copying papers P′ are manually fed one at a time is started when the leading edge of each copying paper P′ is detected by a manual paper feed detecting switch 136. The above described manual paper feeding clutch 132 is actuated with a slight delay when the manual paper feed detecting switch 136 is turned on. The copying paper P or P′ fed into the copying machine 100 is brought to a halt temporarily by the timing rollers 112 and then the timing rollers 112 are driven in synchronism with the rotation of the drum 102 by a proper timing signal so as to transport the copying paper to the transfer charger 106 where the powder image on the drum 102 is transferred onto the copying paper by the action of the transfer charger 106. The copying paper bearing the transferred powder image is separated from the photoreceptor drum 102 by the action of the charge eraser 107 and then is passed by means of a transport belt 113 through a fixing device, whereat the powder image on the copying paper is fixed by the application of heat. The copying paper having the fixed powder image thereon is finally ejected, through a pair of outlet rollers 115, onto a storage tray 116 projecting out of the machine housing.

Meanwhile, an original platform 122 made of transparent materials such as glass etc. is reciprocatingly provided above and adjacent to the upper portion of the machine housing and is provided with a hinged cover 125. The original platform 122 is moved in the direction indicated by an arrow b with an original to be copied (not shown) being disposed between the original platform 122 and the hinged cover 125 for scanning while the original is illuminated from below by an exposure lamp 123, whereby the image of the original is projected onto the surface of the photoreceptor drum 102 through the optical system 104.

Since the original platform 122 is disposed at the central position of the machine housing at the initial operational stage of the copying machine 100, it is first moved in the direction of an arrow a up to a starting position for scanning by starting the copying operation through turning on of either a print switch or a manual paper feed detecting switch 136. The copying machine 100 is so arranged that the original platform 122 is then moved in the direction of the arrow b for scanning and at the same time feeding of copying papers P or P' is started.

For control of above-described copying operations, the copying machine 100 is provided with a microcomputer 200 to be described later, whereby decisions as to an empty cassette 130 or jamming of copying papers P in the passage thereof are made in addition to counter control according to the present invention.

Figure 1:
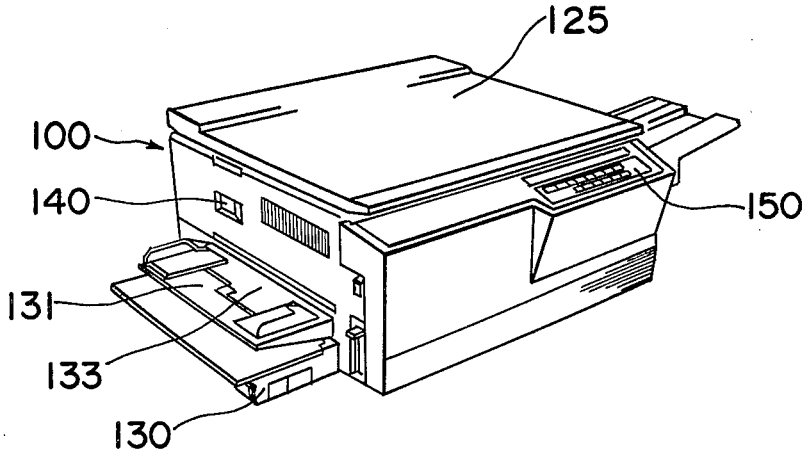
FIG. 1 is a perspective view of an electrophotographic copying machine to which a counter control device according to the present invention may be applied, FIGS. 2(*a*) and 2(*b*) are front elevational views showing, on an enlarged scale, operating panels provided on the copying machine of FIG. 1.
Figure 2A:
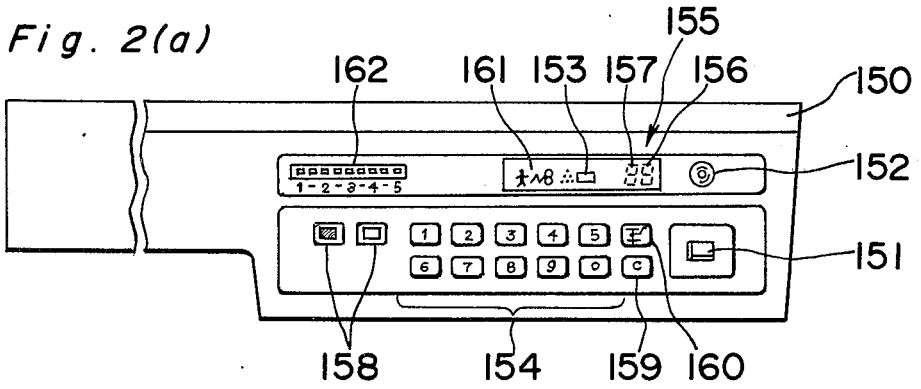
Figure 2B:
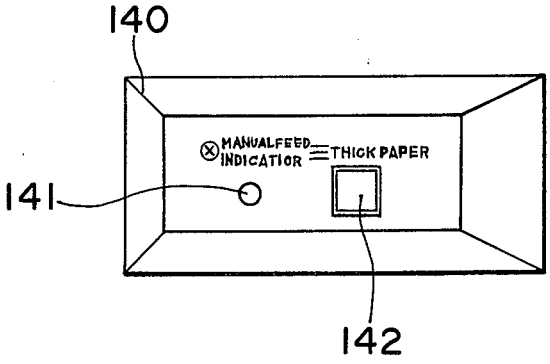

As shown in FIGS. 1, 2(*a*) and 2(*b*), the electrophotographic copying machine 100 is provided with operating panels 140 and 150 at the front side wall and left side wall of the machine housing, respectively.

Referring to FIG. 2(*a*), the operating panel 150 is provided with a print key 151 for starting the copying operation in the multi-copy mode, a power source display lamp 152 for indicating the power source is turned on, ten keys 154 for setting the number of copies to be taken, an indicator 155 for indicating the number of copies set by the ten keys 154 by means of 7-segment indicating elements 156 and 157 which indicate numerals of the first place and the second place, respectively, keys 158 for selectively increasing and decreasing the amount of exposure, a clear-stop key 159, an interrupt key 160 for interrupting the multi-copy mode operation temporarily, and a jam indicator 161 for indicating jamming of copying papers.

Meanwhile, referring to FIG. 2(*b*), the operating panel 140 is provided with a manual feed prohibition indicator 141 which indicates the prohibition of the manual feed mode operation by being turned on during the multi-copy mode operation and a change over switch 142 for changing over to thick papers by increasing the temperature of the heater, etc.

Figure 5:
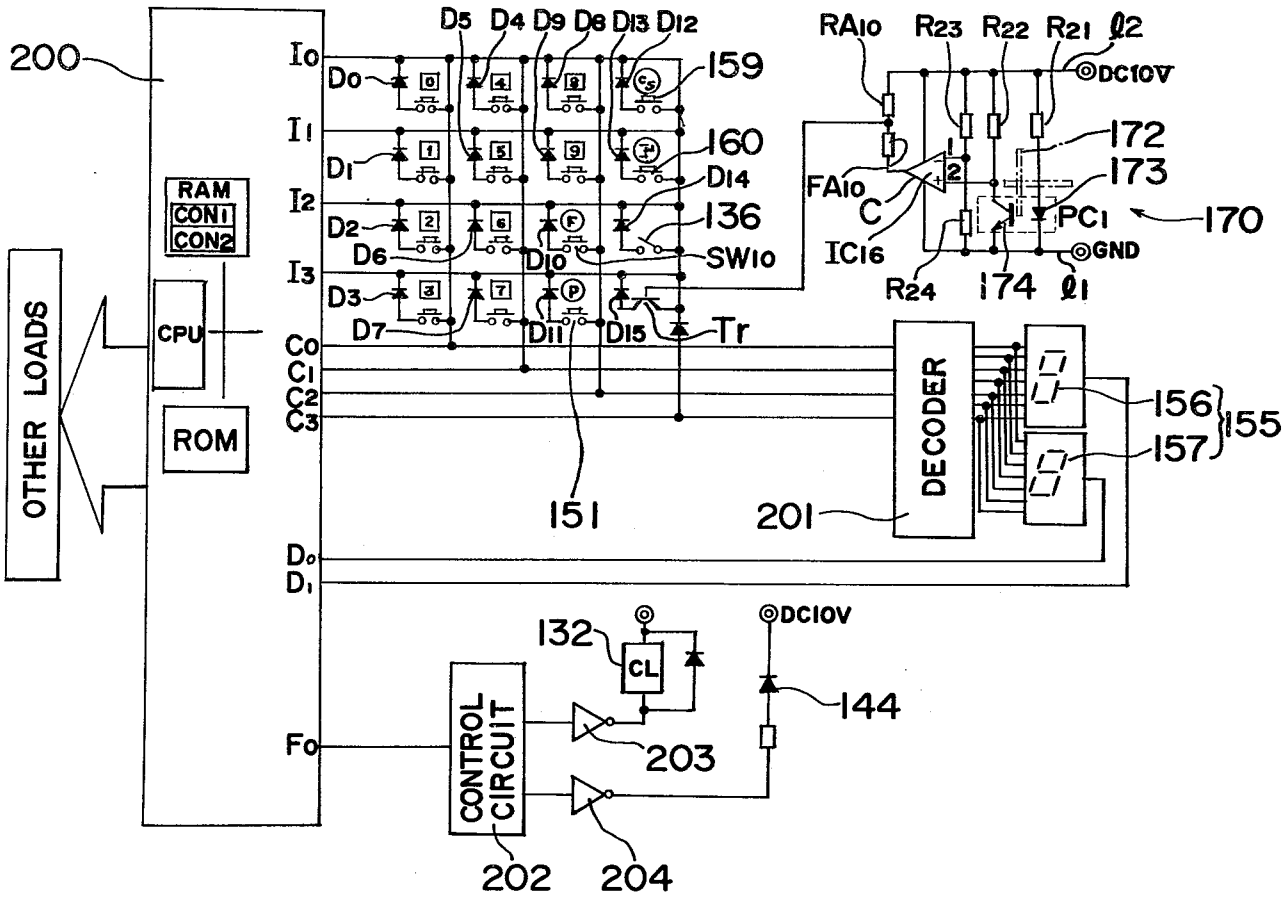
FIG. 5 is an electrical circuit diagram of a control circuit controlled by a microcomputer which is provided in the copying machine of FIG. 1 and FIGS. 6(*a*) to 6(*d*) are flow charts showing processing sequences of operational control of the copying machine by the microcomputer.
Figure 5:
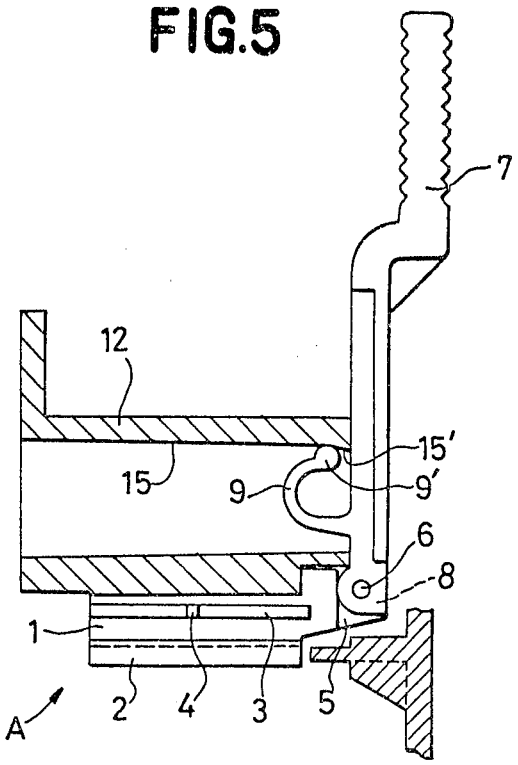

Signals from the print key switch 151, clear-stop key switch 159, interrupt key switch 160, manual paper feed detecting switch 136, etc. as described above are processed for decision by, e.g., a control circuit provided with a microcomputer as shown in FIG. 5 and the operation of the copying machine 100 is controlled by control signals from the control circuit. The above-described control circuit will be described in detail hereinbelow.

Referring now to FIG. 5, there is shown a microcomputer 200 including a central processing unit CPU, a read-only memory ROM and a random access memory RAM or a multi-copy mode counter CON1 and a manual feed mode counter CON2, both of which are provided in a specific area of the random access memory RAM.

The processing sequence is executed in accordance with programs stored in the read-only memory ROM of the microcomputer.

The microcomputer further includes input ports I0, I1, I2 and I3, output terminals C0, C1, C2 and C3, for transmitting a signal for the indicator 155, figure changeover ports $D_1$ and $D_0$ for respectively changing over numerals displayed by the 7-segment indicating elements 156 and 157 of the indicator 155 which is connected, through a decoder 201, to the above described output terminals, an output port F0 for transmitting control signals for a manual paper feeding mechanism and output ports for transmitting control signals for other mechanisms.

The output terminal C0 is connected to the anode of a diode D0 through a key "0" of the ten keys 154, to the anode of a diode D1 through a key "1" of the ten keys 154, to the anode of a diode D2 through a key "2" of the ten keys 154 and to the anode of a diode D3 through a key "3" of the ten keys 154. Cathode of diodes D0, D1, D2 and D3 are connected to the input ports I0, I1, I2 and I3, respectively.

Similarly, the output terminal C1 is connected to the anode of a diode D4 through a key "4" of the ten keys 154, to the anode of a diode D5 through a key "5" of the ten key 154, to the anode of a diode D6 through a key "6" of the ten keys 154 and to the anode of a diode D7 through a key "7" of the ten keys 154. Cathodes of diodes D4, D5, D6 and D7 are connected to the input ports I0, I1, I2 and I3, respectively.

Further, the output terminal C2 is connected to the anode of a diode D8 through a key "8" of the ten keys 154, to the anode of a diode D9 through a key "9" of the ten keys 154, to the anode of a diode D10 through a switch 10 and to the anode of a diode D11 through the print key switch 151. Cathodes of anode D8, D9, D10 and D11 are connected to the input ports I0, I1, I2 and I3, respectively.

Furthermore, the output terminal C3 is connected to the anode of a diode D12 through the clear-stop key switch 159, to the anode of a diode D13 through the interrupt key switch 160, to the anode of a diode D14 through the manual paper feed detecting switch 136 and to the anode of a diode D15 through the emitter-collector circuit of a transistor Tr. Cathodes of diodes D12, D13, D14 and D15 are connected to the input ports I0, I1, I2 and I3, respectively.

Meanwhile, an electrical circuit of a pulse signal generator 170 is connected to the base of the transistor Tr.

The output terminals C0, C1, C2 and C3 are connected, through the driver circuit 201, to the indicator 155 including 7-segment indicating elements 156 and 157.

The figure changeover ports $D_1$ and $D_0$ are respectively connected to 7-segment indicating elements 156 and 157 for indicating numerals of the first place and the second place, respectively.

The output port F0 is connected to a control circuit 202 having two outputs. One output of the control circuit 202 is connected to the manual paper feeding clutch 132 through an inverter 203. The other output of the control circuit 202 is connected to the manual feed prohibition indicator 141 through an inverter 204.

Referring to the above described electrical circuit of the pulse signal generator 170, the circuit includes a lamp 173, a photo detector 174 and a comparator C. The lamp 173 and comparator C are connected in parallel between a lead line l1 and a lead line l2. Suitable resistors R23 and R24 are connected in series between the lines l1 and l2 to provide a reference voltage to one input of the comparator C. The other input of the comparator C is connected to a junction between a resistor R22 and the photo detector 174 which are connected in series between the lines l1 and l2. The lamp 173 and photo detector 174 form a photo coupler PC1.

Figure 4:
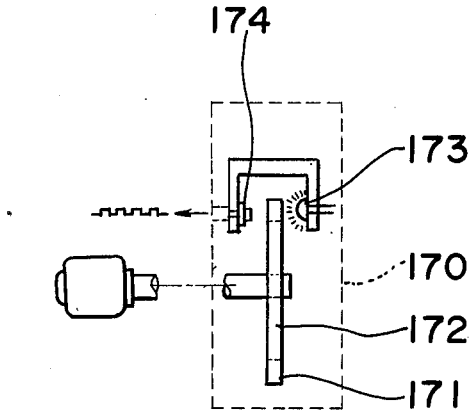
FIG. 4 is a schematic view showing, on an enlarged scale, an arrangement of a pulse signal generator provided in the copying machine of FIG. 1.

Meanwhile, as shown in FIG. 4, the pulse signal generator 170 has such an arrangement in which a disc 172 with a number of slits 171 formed at an equal interval along the circumference is disposed between the lamp 173 and the photo detector 174.

An output of the comparator C is connected to the base of the transistor Tr and is so arranged as to be set to the HIGH state when light emitted from the lamp 173 reaches the photo detector 174 through the slits 171. In response to the rotation of the disc 172, the comparator C transmits pulse signals proportional to the rotational speed of the disc 172 to the base of the transistor Tr.

In response to the rotation of the disc 172 synchronous with a speed of a main drive motor 101, pulse signals are generated by slits 171 of the disc 172, lamp 173 and photo detector 174 and are transmitted to the microcomputer 200 so as to synchronize the copying operation of the copying machine 100 with the control state of the microcomputer 200 and to check the rotation of the motor 101.

As described above, the microcomputer 200 and control circuit 202 are related to various switches and each mechanism of the copying machine 100. Operation of each mechanism of the copying machine 100 and check of various switches are controlled in accordance with programs stored in the read-only memory ROM of the microcomputer 200.

One example of the concrete processing sequence will be described in accordance with flow charts in FIGS. 6(*a*) to 6(*d*). It is to be noted here that in the flow charts above, the processing sequence is described directly by time-sharing in a program routine in which the processing time is limited by internal timers having a total preset time of 10 msec. Of 10 msec, 3 msec are alloted to a timer t2 for indicating a numeral of the first place (156), another 3 msec a timer t3 for indicating a numeral of the second place (157), 2 msec a timer t4 for synchronizing operations of the motor 101 and copying machine 100 with the control state of the microcomputer 200 and the remaining 2 msec a timer t1 for scanning various switches. These internal timers are digital timers which properly divide or count a clock, operational timing standard of the microcomputer 200, and are provided in a predetermined area of the random access memory ROM or a register in the microcomputer 200. The internal timers are provided mainly so as to prevent variations in processing time due to changes in quantity of the processing to be executed during the preset time of each timer.

Figure 6:
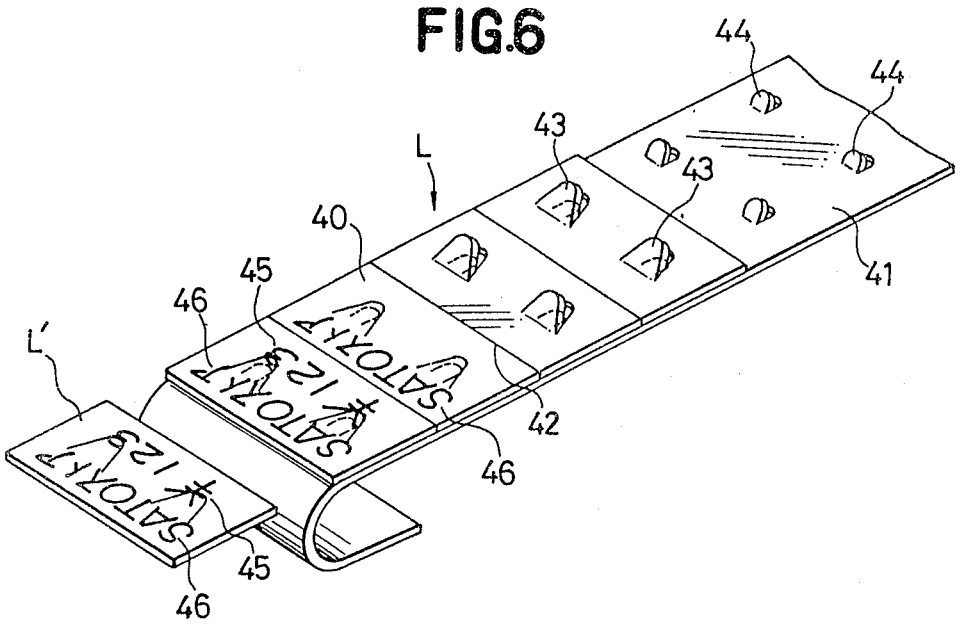
Figure 6B:
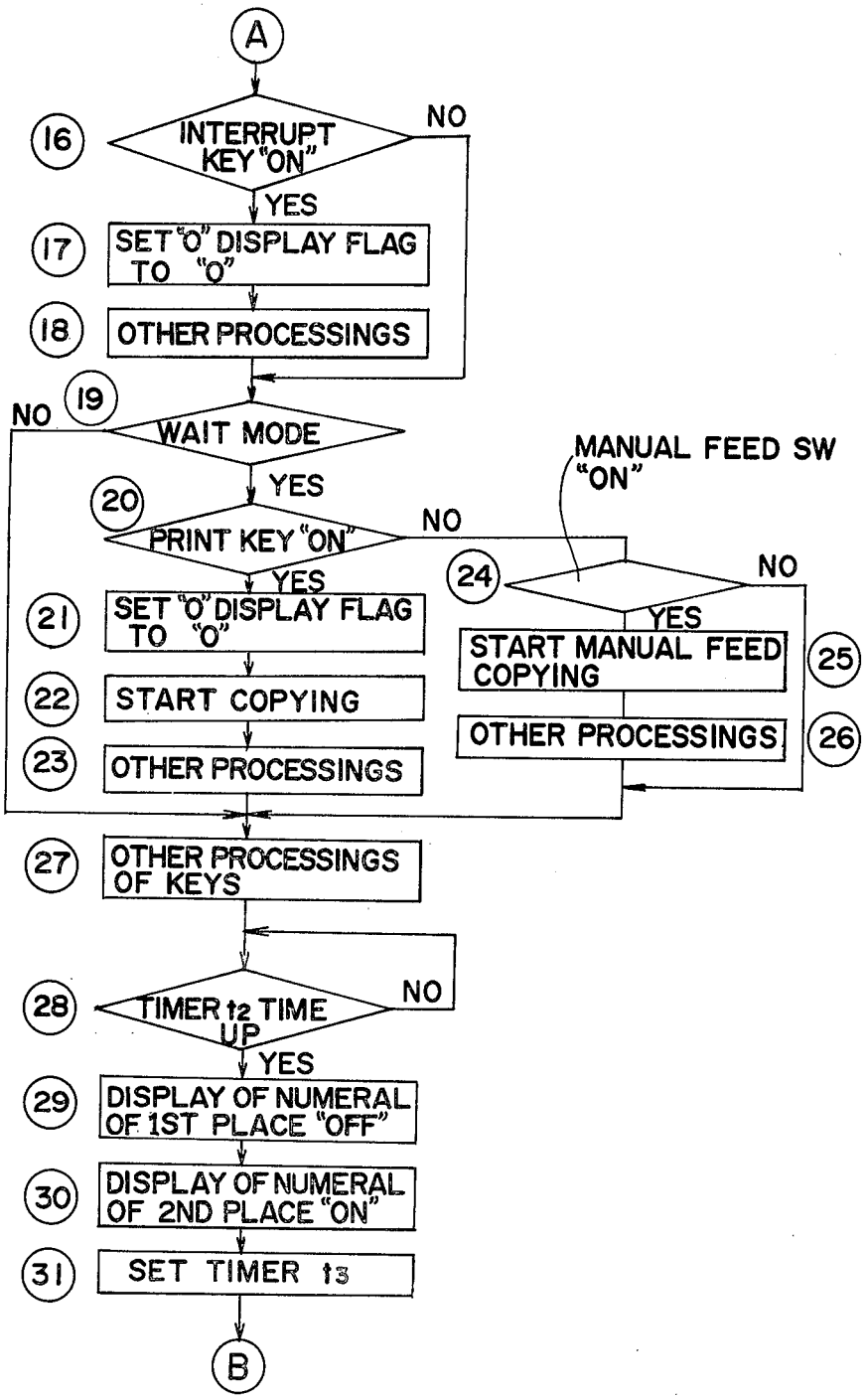
Figure 6C:
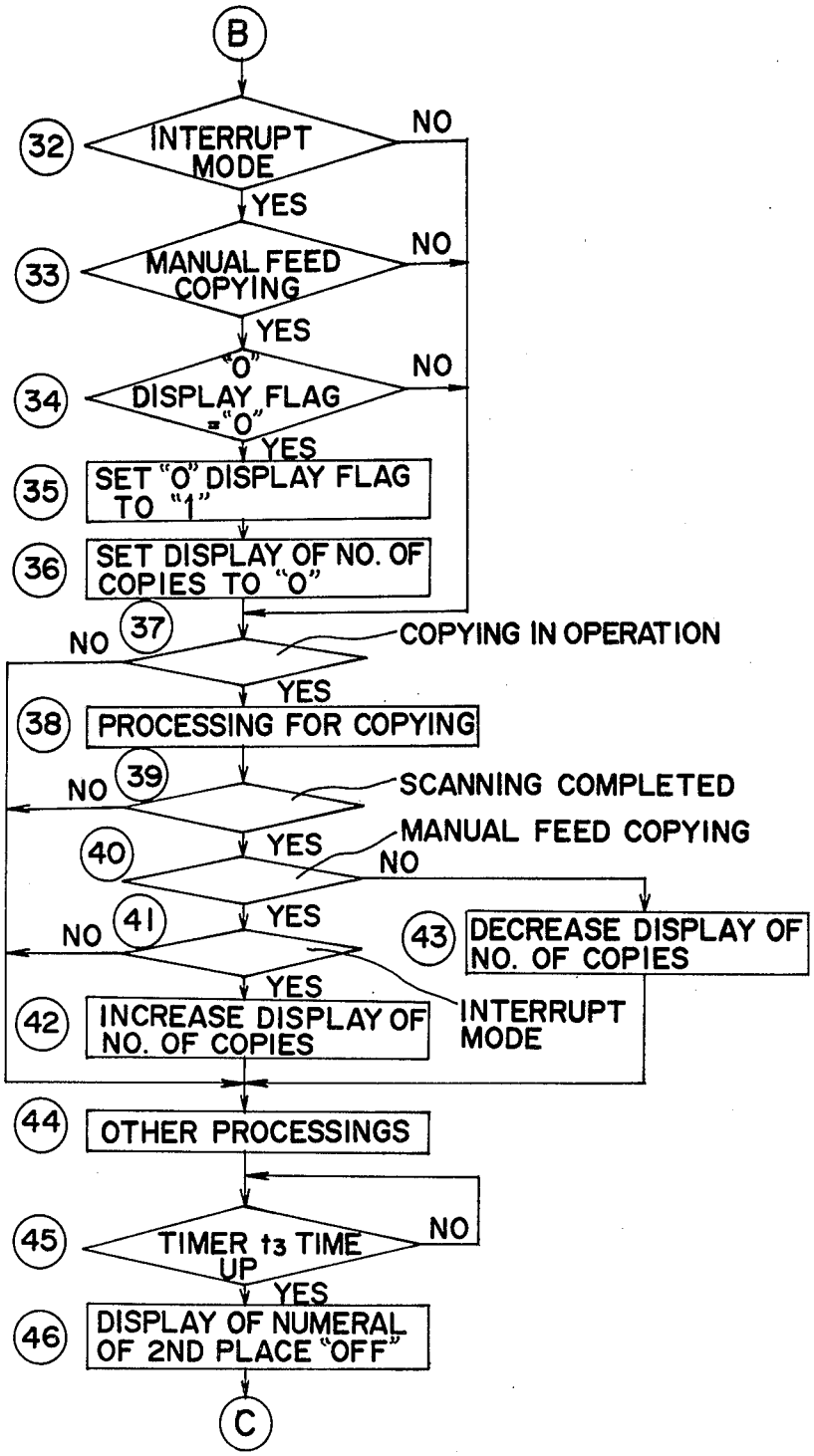
Figure 6D:
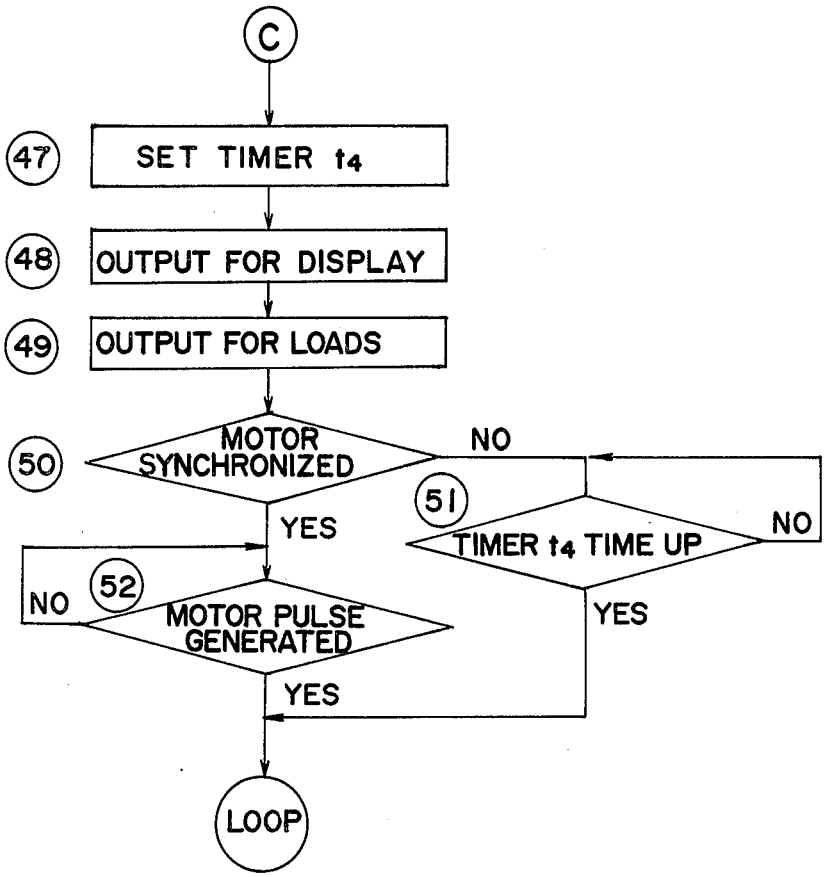

Referring to FIG. 6(*a*), at the step ①, an initial setting is performed, when the indicator 155 for the number of copies to be made is set to "1," the exposure amount indication is set to a standard value, the copying machine 100 is set to the normal copying mode and the random access memory RAM is cleared. At the subsequent step ②, the internal timer t1 with a preset time of 2 msec is set so as to limit the time period required for scanning a key input. At the step ③, inputs of keys are scanned. If it is found at the step ④ that the preset time (2 msec) of the internal timer t1 has elapsed, the indicating element 156 for the numeral of the first place is turned on at the step ⑤ and the internal timer t2 with a preset time of 3 msec is set so as to limit the time period required for indicating the numeral of the first place by time-sharing at the step ⑥. At the step ⑦, a decision is made as to whether or not any of ten keys are being depressed so as to set the number of copies to be taken in the multi-copy mode. In the case of "NO," the step ⑩ follows. In the case of "YES," a "0" display flag is set to "0" at the step ⑧, and other processings are performed at the step ⑨. The "0" display flag is a flag for deciding whether or not "0" is indicated in the indicator 155 for the number of copies at the time of start of copying in the manual feed mode.

The step ⑩, a decision is made as to whether or not the clear-stop key 159 is depressed. In the case of "NO," the step ⑯ follows. In the case of "YES," a decision is made as to whether or not copying in the wait mode is being performed at the step ⑪. When the copying machine 100 is in the wait mode, copying may be started or final scanning has been completed. Unless the copying machine 100 is in the wait mode, copying is being performed. In the case of "NO," copying is stopped at the step ⑬ followed by the step ⑭. In the case of "YES," the indicator 155 for the number of copies to be made is set to display "1" at the step ⑫, the "0" display flag is set to "0" at the step ⑭ and other processings are performed at the step ⑮.

Then, at the step ⑯ in FIG. 6(*b*), a decision is made as to whether or not the interrupt key 160 is depressed. In the case of "NO," the step ⑲ follows. In the case of "YES," the "0" display flag is set to "0" at the step ⑰ and other processings are performed at the step ⑱, whereby copying is stopped, the copying machine 100 is set to the interrupt mode and the contents of the counters CON1 and CON2 are stored in the memory of the microcomputer 200 and when the interrupt key is depressed in the interrupt mode, the copying machine 100 is reinstated to the normal mode and the contents of the counters are indicated.

At the step ⑲, a decision is made as to whether or not copying in the wait mode is being performed. In the case of "NO," the step ㉗ follows. In the case of "YES," a decision is made as to whether or not the print key 151 is depressed at the step ⑳. In the case of "YES," the "0" display flag is set to "0" at the step ㉑, copying in the multi-copy mode is started at the step ㉒ and other processings are performed at the step ㉓ followed by the step 27. In the case of "NO," a decision is made as to whether or not the manual paper feed detecting switch 136 is turned on at the step ㉔. In the case of "NO," the step ㉗ follows. In the case of "YES," copying in the manual feed mode is started at the step ㉕ and other processings are performed at the step ㉖ followed by the step ㉗.

When the copying machine 100 is in the multi-copy mode, the copying machine 100 is not in the wait mode and thus, copying in the manual feed mode cannot be performed.

Meanwhile, when scanning of final copying has been completed, the copying machine 100 is set to the wait mode.

The the step ㉗, other processings of inputs of keys are performed. If it is found at the step ㉘ that the preset time (3 msec) of the internal timer t2 has elapsed, the indicating element 156 for the numeral of the first place is turned off at the step ㉙, the indicating element 157 for the numeral of the second place is turned on at the step ㉚ and the internal timer t3 with a preset time of 3 msec is set at the step ㉛ so as to indicate the numeral of the second place.

Referring now to FIG. 6(*c*), at the step ㉜, a decision is made as to whether or not copying in the interrupt mode is being performed. In the case of "NO," the step 37 follows. In the case of "YES," a decision is made as to whether or not copying in the manual feed mode is being performed at the step 33. In the case of "NO," the step 37 follows. In the case of "YES," a decision is made as to whether or not the "0" display flag is being set to "0" at the step 34. In the case of "NO," the step 37 follows. In the case of "YES," the "0" display flag is set to "1" at the step 35 and the indicator 155 for the number of copies to be made is set to display "0" at the step 36.

At the step 37, a decision is made as to whether or not copying is being performed. In the case of "NO," the step 44 follows. In the case of "YES," processings for copying is performed at the step 38 and a decision is made as to whether or not scanning has been completed at the step 39. In the case of "NO," the step 44 follows. In the case of "YES," a decision is made as to whether or not copying in the manual feed mode is being performed at the step 40. In the case of "NO," the figure of the number of copies to be made is decreased by one at the step 43 followed by the step 44. In the case of "YES," a decision is made as to whether or not copying in the interrupt mode is being performed at the step 41. In the case of "NO," the step 44 follows. In the case of "YES," the figure of the number of copies actually made is increased by one at the step 42 and other processings are performed at the step 44.

Accordingly, the indication for the number of copies to be made is performed in such a way that, when copying in the multi-copy mode is performed, the figure of the desired number of copies to be made is decreased one by one, and when copying in the manual feed mode is performed during the interrupt mode, the figure of the number of copies actually made is increased one by one after setting the indicator 155 to display "0."

Then, if it is found at the step 45 that the preset time (3 msec) of the timer t3 has elapsed, the indicating element 157 for the numeral of the second place is turned off at the step 46.

Referring now to FIG. 6(*d*), the internal timer t4 with a preset time of 2 msec is set so as to synchronize operations of the motor 101 and copying machine 100 with the control state of the microcomputer 200 at the step 47, an output for display is produced at the step 47 and an output for loads is produced at the step 49.

Then, at the step 50, a decision is made as to whether or not the operation of the motor 101 is synchronized with the control state of the microcomputer 200. In the case of "YES," a decision is made as to whether or not a motor pulse is generated at the step 52. In the case of "YES" at the step 52, the processing sequence is fed back to the step 2 in FIG. 6(*a*). In the case of "NO" at the step 50, a decision is made as to whether or not the preset time (2 msec) of the internal timer t4 has elasped. In the case of "YES," the processing sequence is also fed back to the step 2 in FIG. 6(*a*).

Thus, one routine of the program stored in the microcomputer 200 is completed.

Each time internal timers starts the timing operation, one processing routine of the program from the step 2 to the step 52 is executed.

Meanwhile, in the above described embodiment, the interrupt key 160 is employed for interrupting copying in the multi-copy mode so as to enable copying in other modes and thus, the manual feed mode counter CON2 is operated.

But, the interrupt key 160 may be substituted by other key. However, if copying in the manual feed mode is performed by interrupting copying in the multi-copy mode with the interrupt key 160, the multi-copy mode counter CON1 is automatically changed over to the manual feed mode counter CON2, thus improving the working efficiency remarkably.

As is clear from the foregoing description, in an electrophotographic copying machine operable selectively in one of the multi-copy mode wherein a copying operation is repeated to produce a plurality of copies with copying papers being automatically fed one at a time and the manual feed mode wherein the copying operation is carried out with copying papers fed manually one at a time, a control counter device according to the present invention comprises a counter means for performing a counting operation each time one cycle of copying operation in the multi-copy mode completes; a display means for displaying a numerical figure in association with count contents of the counter means; a manual feed mode counter means capable of performing a counting operation each time one cycle of copying operation in the manual feed mode completes; a setting means for causing the manual feed mode counter to be operative; and a control means for causing the display means to display count contents of the manual feed mode counter means only when the copying operation in the manual feed mode is performed with the manual feed mode counter means being made operable by the setting means.

Accordingly, in an electrophotographic copying machine to which a counter control device according to the present invention is applied as described above, it is possible to display the number of copies made on the manually fed papers by the use of the display means for displaying the number of copies to be made in the multi-copy mode, without utilizing any other complicated counter device of special display device. Thus, the counter control device described above does not require an operator of the machine to pay attention to the number of copies when copying in the manual feed mode is performed.

Furthermore, when the copying machine is switched over to the manual feed mode, count contents of the counter means during the normal mode is stored in the memory and the figure displayed by the display means is reset to "0," so that the number of copies actually made is counted upon starting of copying in the manual feed mode, without any special operation.

Moreover, the counter control device is provided with a clear means for resetting the figure displayed by the display means to "0," thus improving the working efficiency of, especially, copying of a great number of copies to be made in the manual feed mode.

Moreover, if the above described copying machine is of such a type that copying in the manual feed mode is started when a leading edge of the copying paper is detected at the inlet portion for manually fed copying papers, the display means can be so controlled as to display a constant figure by the control means when copying in the manual feed mode is performed without operating the setting means.

Meanwhile, if the copying machine is further provided with an interrupt operating means for interrupting copying in the multi-copy mode so as to enable copying in other modes, the interrupt operating means can be substituted by the above described setting means.

Furthermore, the control means can be so arranged as to perform a function of clearing the figure displayed by the display means when copying in the manual feed mode is started with copying in the multi-copy mode being interrupted in response to an operation of the setting means.

Meanwhile, the control means can be so arranged as to perform a function of clearing the figure displayed by the display means when copying in the manual feed mode is started with copying in the multi-copy mode being interrupted in response to an operation of the interrupt operating means.

Moreover, the copying machine can further include means for cancelling an operative state of the manual feed mode counter means and the control means can be provided with a function of clearing, in response to an operation of the cancelling means the figure displayed by the display means which displays count contents of the manual feed mode counter means.

In the copying machine including an interrupt operating means for interrupting copying in the multi-copy mode so as to enable copying in other modes and for storing count contents of the counter means at the time of the interruption and means for cancelling the interrupt mode, it can be so arranged that the setting means acts as the interrupt operating means and the control means performs functions not only of clearing, in response to an operation of the cancelling means, the figure displayed by the display means which displays count contents of the manual feed mode counter means but of causing the display means to display count contents of the counter means which have been stored.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A counter control device for use in an electrophotographic copying machine arranged to be operable selectively in one of a multi-copy mode wherein a copying operation is repeated to produce a plurality of copies, with copying papers being automatically fed one at a time and a manual feed mode wherein the copying operation is carried out by the use of copying papers fed manually one at a time, said counter control device comparising:

a counter means for performing a counting operation each time one cycle of copying operation in the multi-copy mode completes;

a display means for displaying a numerical figure in association with count contents of said counter means, a manual feed mode counter capable of performing a counting operation each time one cycle of copying operation in the manual feed mode completes;

a setting means for causing said manual feed mode counter to be operative; and a control means for causing said display means to display count contents of said manual feed mode counter means only when the copying operation in the manual feed mode is performed with said manual feed mode counter means being made operable by said setting means.

2. A counter control device as claimed in claim 1, said electrophotographic copying machine being of such a type that a copying operation in the manual feed mode is started when a leading edge of the copying paper is detected at an inlet portion for manually fed copying papers, said control means causing said display means to display a constant numerical figure when the copying operation in the manual feed mode is performed without operating said setting means.

3. A counter control device as claimed in claim 1 said electrophotographic copying machine being provided with an interrupt operating means for interrupting a copying operation in the multi-copy mode so as to enable the copying operation in other modes, said setting means acting as said interrupt operating means.

4. A counter control device as claimed in claim 1 or claim 2, wherein said control means performs a function of clearing a numerical figure displayed by said display means when a copying operation in the manual feed mode is started with the copying operation in the multi-copy mode being interrupted in response to an operation of said setting means.

5. A counter control device as claimed in claim 3, wherein said control means performs a function of clearing a numerical figure displayed by said display means when a copying operation in the manual feed mode is started with the copying operation in the multi-copy mode being interrupted in response to an operation of said interrupt operating means.

6. A counter control device as claimed in claim 1 or claim 2, said electrophotographic copying machine further including means for cancelling an operative state of the manual feed mode counter means, said control means performing a function of clearing, in response to the cancelling operation, a numerical figure displayed by said display means which displays count contents of said manual feed mode counter means.

7. A counter control device as claimed in any one of claims 1, 2 or 5, said electrophotographic copying machine further including an interrupt operating means for interrupting a copying operation in the multi-copy mode so as to enable the copying operation in other modes and for storing count contents of said counter means at the time of the interruption and means for cancelling the interrupt mode, said setting means acting as said interrupt operating means, said control means performing functions not only of clearing, in response to an operation of said cancelling means a numerical figure displayed by said display means which displays count contents of said manual feed mode counter means but of causing said display means to display count contents of said counter means which have been stored.

* * * * *